US010829972B2

(12) United States Patent
Harari

(10) Patent No.: US 10,829,972 B2
(45) Date of Patent: Nov. 10, 2020

(54) STEPLESS SLIDING DOORS SYSTEM

(71) Applicant: Mordechai Harari, Rishon Lezion (IL)

(72) Inventor: Mordechai Harari, Rishon Lezion (IL)

( * ) Notice: Subject to any disclaimer, the term of this patent is extended or adjusted under 35 U.S.C. 154(b) by 98 days.

(21) Appl. No.: 16/092,489

(22) PCT Filed: May 8, 2017

(86) PCT No.: PCT/IL2017/050506

§ 371 (c)(1),
(2) Date: Oct. 10, 2018

(87) PCT Pub. No.: WO2017/179062

PCT Pub. Date: Oct. 19, 2017

(65) Prior Publication Data

US 2019/0128035 A1 May 2, 2019

(30) Foreign Application Priority Data

Apr. 10, 2016 (IL) ..... 245025

(51) Int. Cl.
*E05D 15/10* (2006.01)

(52) U.S. Cl.
CPC ..... *E05D 15/1042* (2013.01); *E05D 15/1005* (2013.01); *E05D 2015/1026* (2013.01); *E05D 2015/1031* (2013.01); *E05Y 2201/40* (2013.01); *E05Y 2201/412* (2013.01); *E05Y 2201/426* (2013.01); *E05Y 2201/62* (2013.01); *E05Y 2201/64* (2013.01); *E05Y 2900/132* (2013.01)

(58) Field of Classification Search
CPC . E05D 15/1068; E05D 15/1013; E05D 15/10; E05D 2015/1031; E05D 2015/1071; E05D 2015/1086; E05D 2015/1055; E05D 2015/1039; E05D 2015/1052; E05D 2015/106; E05D 2015/1042; B61D 19/008; B61D 19/009
See application file for complete search history.

(56) References Cited

U.S. PATENT DOCUMENTS 3,179,986 A 4/1965 Madland
3,269,059 A 8/1966 Bailey
(Continued)

FOREIGN PATENT DOCUMENTS

WO WO2012011099 1/2012

*Primary Examiner* — Justin B Rephann
(74) *Attorney, Agent, or Firm* — Alphapatent Associates, Ltd; Daniel J. Swirsky

(57) ABSTRACT

The present invention is directed to a stepless sliding doors system, comprising: two sliding doors (10), at least one of them comprising: two vertical poles (30); means (50) for rotating each of the vertical poles (30); to each side of the vertical poles (30) is firmly connected a hand-connector (36); each of the hand-connectors (36) is pivotally connected to a rail-cart (18) having two rollers (42); each of the rail-carts (18) comprises a horizontal hinge (58) disposed between the rollers (42), and a vertical springy hinge (70), for applying pulling or pushing force of the rollers on a rail thereof, thereby allowing placing the sliding doors of the system in the same plane when in the closed state of the doors, and shifting the doors one along the other in the open state thereof, and additionally preventing the wheels to deviate from a rail in the case of slight deformations.

9 Claims, 21 Drawing Sheets

(56) References Cited

U.S. PATENT DOCUMENTS

| | | | | | |
|---|---|---|---|---|---|
| 3,383,798 | A * | 5/1968 | Day | E06B 3/4645 | 49/219 |
| 3,413,758 | A * | 12/1968 | Palsson | E05B 83/02 | 49/220 |
| 3,417,515 | A * | 12/1968 | Thorvald | B61D 19/009 | 49/220 |
| 3,660,938 | A * | 5/1972 | Ross, Jr. | E05D 15/1007 | 49/220 |
| 3,797,170 | A | 3/1974 | Lemon | | |
| 4,662,110 | A * | 5/1987 | Rokicki | E05D 15/1013 | 49/220 |
| 4,691,474 | A | 9/1987 | Rokicki | | |
| 4,726,145 | A * | 2/1988 | Rokicki | E05D 15/1013 | 49/220 |
| 5,263,280 | A * | 11/1993 | Dilcher | B61D 19/009 | 49/212 |
| 5,735,080 | A * | 4/1998 | Pratolongo | E05D 15/34 | 312/325 |
| 6,385,910 | B1 * | 5/2002 | Smink | B60J 5/062 | 49/218 |
| 6,546,611 | B1 * | 4/2003 | Ryan | E05B 17/0058 | 29/401.1 |
| 6,644,215 | B1 * | 11/2003 | Mundinger | B61D 19/009 | 105/240 |
| 10,449,976 | B2 * | 10/2019 | Yamaguchi | E05C 1/08 | |
| 2009/0193736 | A1 * | 8/2009 | Halfon | E06B 3/4636 | 52/291 |
| 2013/0118086 | A1 * | 5/2013 | Halfon | E05D 15/10 | 49/360 |
| 2016/0215543 | A1 * | 7/2016 | Mair | E05D 15/1068 | |

* cited by examiner

FRONT VIEW

TOP VIEW

BACK VIEW

STEPLESS SLIDING DOORS SYSTEM

CROSS-REFERENCE TO RELATED APPLICATIONS

This application is a U.S. National Phase Application under 35 U.S.C. 371 of International Application No. PCT/IL2017/050506, which has an international filing date of May 8, 2017, and which claims priority and benefit from Israel Patent Application No. 245025, filed Apr. 10, 2016, the contents and disclosure of which are incorporated herein by reference in their entirety.

TECHNICAL FIELD

The present invention relates to the field of sliding doors. More particularly, the invention relates to a stepless sliding door system.

BACKGROUND ART

The term "sliding doors system" refers herein as to two or more sliding doors opened/closed by sliding one door in parallel to the other.

FIG. 1*a* is a front view which schematically illustrates a sliding doors system in a closed state, according to the prior art. FIG. 1*a* also defines a cross-section A-A. FIG. 1*b* is a top view which schematically illustrates the cross-section A-A of FIG. 1*a*. In order to facilitate the understanding, the projection lines are not drawn in the cross-section FIG. 1*b*.

As illustrated in FIG. 1*b*, in the closed state of the sliding doors system, the front panels 38*a* and 38*b* of the sliding doors 10*a* and 10*b* are not in the same plane. In other words, in the closed state of the sliding doors system, the doors generate a "step". The step is pointed out by reference numeral 40.

FIG. 2*a* is a front view which schematically illustrates the sliding doors system of FIG. 1 in an open state. FIG. 2*a* also defines a cross-section B-B. FIG. 2*b* is a top view which schematically illustrates the cross-section B-B of FIG. 2*a*. In order to facilitate understanding, the projection lines are not drawn in the cross-section figure.

It is an object of the present invention to provide a stepless sliding doors system, i.e., a sliding doors system in which upon closing the doors, the doors are situated such that their front panels are situated at the same plane.

Other objects and advantages of the invention will become apparent as the description proceeds.

SUMMARY OF THE INVENTION

The present invention is directed to a stepless sliding doors system, comprising: two sliding doors (10), at least one of them comprising: two vertical poles (30); means (50) for rotating each of the vertical poles (30); to each side of the vertical poles (30) is firmly connected a hand-connector (36); each of the hand-connectors (36) pivotally connected to a rail-cart (18) having two rollers (42); each of the rail-carts (18) comprising a horizontal hinge (58) disposed between the rollers (42), and a vertical springy hinge (70), for applying pulling or pushing force of the rollers on a rail thereof, thereby allowing placing the sliding doors of the system such that their front panels are in the same plane when in the closed state of the doors, and shifting the doors one along the other in the open state thereof, and additionally preventing the wheels deviating from a rail in the case of slight deformations.

In one aspect, the present invention is directed to a stepless sliding door system, comprising:

- two sliding doors (10*a*, 10*b*) disposed in a closed state thereof on the same plane, along an upper and lower parallel rails (16), at least one of the doors having:
  - a chassis (46) connected to the sliding door;
  - two vertical rotatable poles (30);
  - two pairs of rail-carts (18);
  - two pairs of hand-connectors (36*a*, 36*b*), each of the hand-connectors firmly connected in one end thereof to one of the vertical rotatable poles (30), and pivotally connected in the other end thereof to one of the rail-carts (18);
  - two spiral rotation assemblies (72*a*, 72*b*), each comprising a vertically shiftable tube (50) in which one of the vertical rotatable poles (30) is disposed, for rotating each of the vertical poles (30) by 90 degrees upon shifting the vertically shiftable tube (50); and
  - a transverse rod (60, 54), connecting the vertically shiftable tube (50) of each of the spiral rotation assemblies (72*a*, 72*b*), for allowing simultaneous shifting of the vertically shiftable tube (50);

thereby upon vertically shifting one of the vertically shiftable tubes (50), simultaneously rotating the vertical poles (30), resulting in distancing the chassis from the pair of rails (16), thereby placing the sliding door in parallel to the other sliding door, distantly from the other sliding door, thereby allowing sliding the door in parallel to the other door of the sliding door system such that the doors do not block each other.

According to one embodiment of the invention, the transverse rod comprises: a telescopic rod (60) having a tube (22) and two shafts (24*a*, 24*b*), each pivotally connected to one of the vertical poles (30); and a hinge (20) for pivotally connecting the tube (22) to the chassis. The system may further comprise an electric motor (52), for shifting one of the vertically shiftable tubes (50), thereby automating sliding the doors.

According to another embodiment of the invention, the transverse rod comprises: a horizontal bar (54), firmly connected to the vertically shiftable tubes (50), thereby upon vertically shifting one of the vertically shiftable tubes (50), simultaneously shifting the other tube. The system may further comprise an electric motor, for vertically shifting the horizontal bar (54) or the vertically shiftable tube (50).

According to one embodiment of the invention, the chassis (46) hangs on the upper of the pair of rails. According to another embodiment of the invention, the chassis stands on the lower of the pair of rails.

According to one embodiment of the invention, each of the rail-carts is gyroscopic.

According to one embodiment of the invention, each of the rail-carts (18) comprises:

- a vertical springy hinge (70) comprising:
  - a tube (32);
  - a vertical rod (56) disposed in the tube (32);
  - a spring (34), for applying pulling or pushing force on the vertical rod (56);
  - setting means (74), for setting an operation of the spring (34) to push or pull the vertical rod (56); and
  - fixing means (76), for fixing the vertical hinge to the chassis (46);
- a base (64);
- a horizontal hinge (58), for pivotally connecting the vertical hinge (70) to the base (64);
- two rollers (42) pivotally connected to the base (64) from each side of the horizontal hinge (58);

thereby increasing the ability of the rollers (42) to stay on a rail (16) in the case of deformations of the rail.

According to another embodiment of the invention, each of the rail-carts (18) comprises:

a base (64);

a ball bearing (62), for connecting the base (64) to a corresponding hand-connector (36);

two rollers (42) connected to the base (64) from each side of the ball bearing (62); and a spring (34), for applying pulling or pushing force on the base (64);

thereby increasing the ability of the rollers (42) to stay on a rail (16) in the case of deformations of the rail.

In yet another aspect, the present invention is directed to a stepless sliding door system, comprising:

two sliding doors (10), at least one comprising:

two vertical poles (30);

to each side of the vertical poles (30) is firmly connected a hand-connector (36);

each of the hand-connectors (36*a*, 36*b*) is pivotally connected a rail-cart (18) having two rollers (42);

each of the rail-carts (18) comprises a horizontal hinge (58) disposed between the rollers (42), and a vertical springy hinge (70) for applying pulling or pushing force of the rollers on a rail thereof;

means for rotating each of the vertical poles (30) by 90 degrees, in the form of a motorized telescopic rod (84, 82*a*, 82*b*) pivotally connected to the hand connectors (36*a*, 36*b*) or to the rail carts (18);

thereby allowing placing the sliding doors of the system in the same plane when in the closed state of the doors, and shifting the doors one along the other in the open state thereof, and additionally preventing the wheels deviating from a rail in the case of slight deformations.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

BRIEF DESCRIPTION OF DRAWINGS

Preferred embodiments, features, aspects and advantages of the present invention are described herein in conjunction with the following drawings:

FIG. 2*a* also defines a cross-section B-B.

Figure 20:
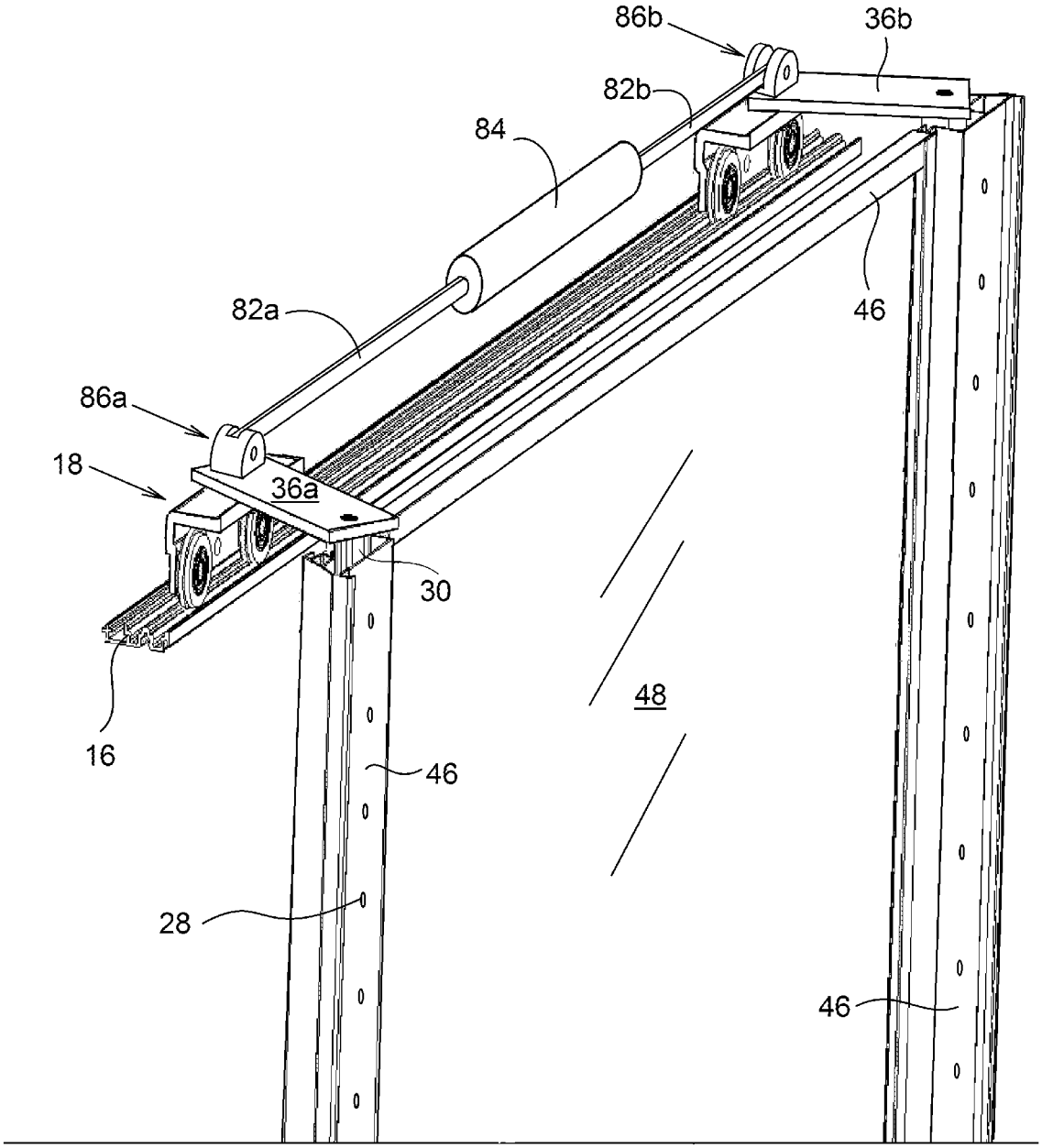
Figure 21:
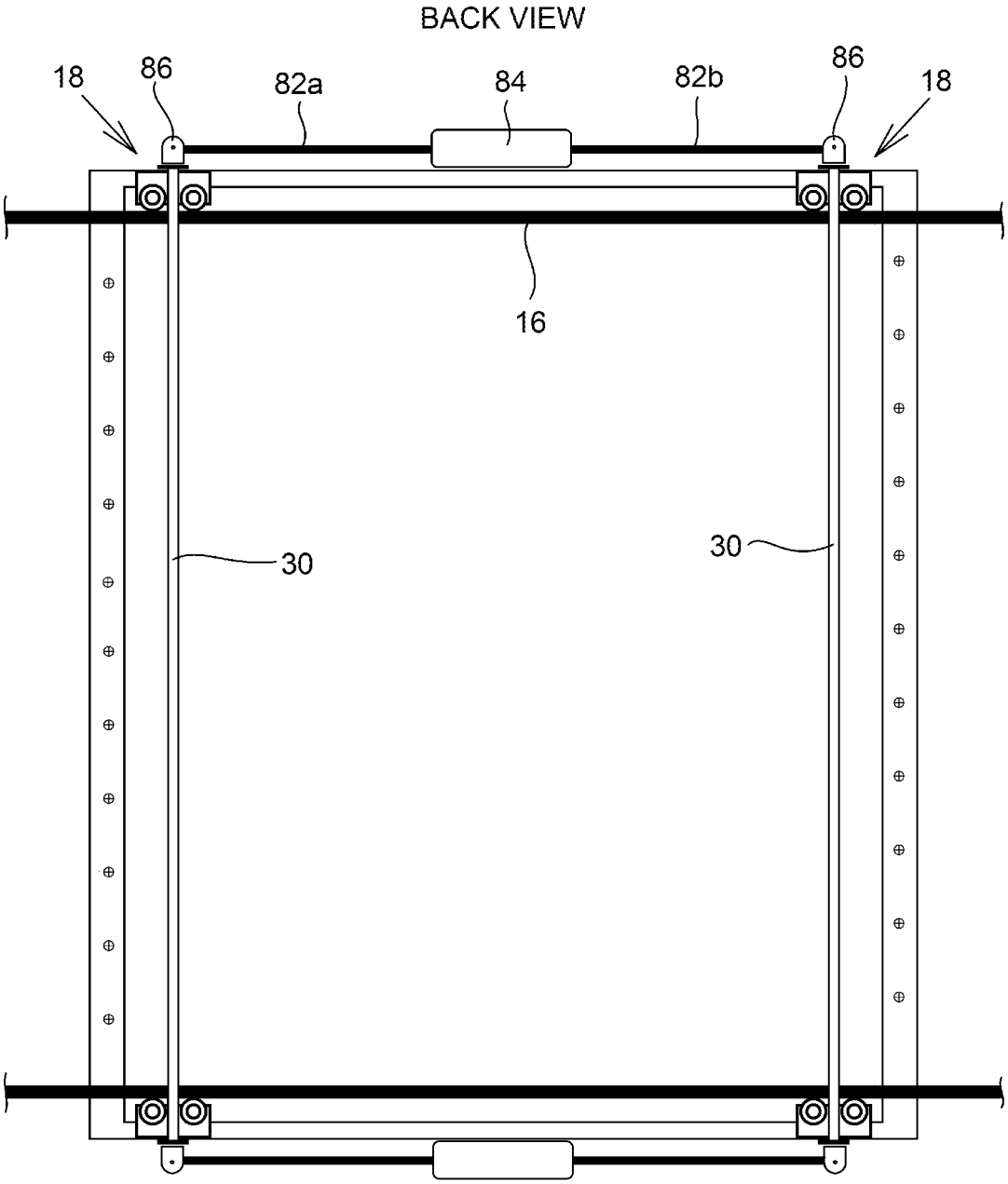
Figure 22A:
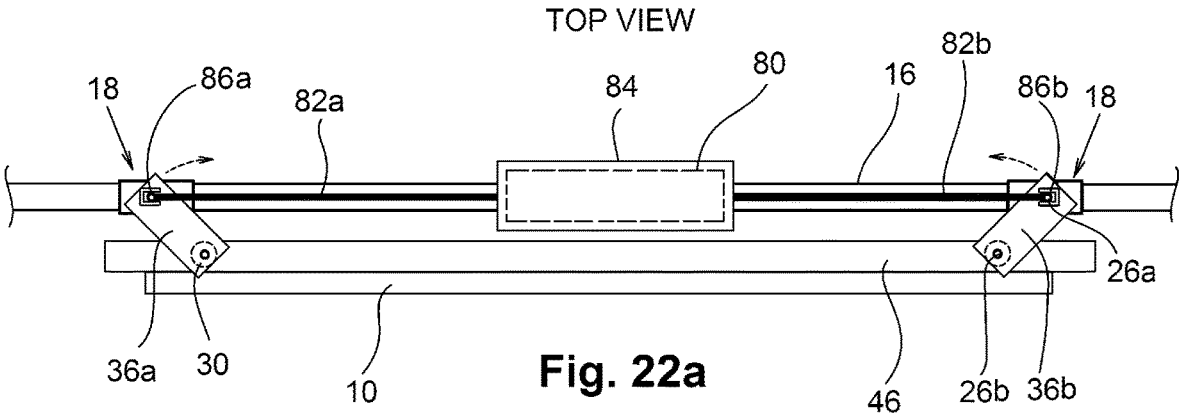
Figure 22B:
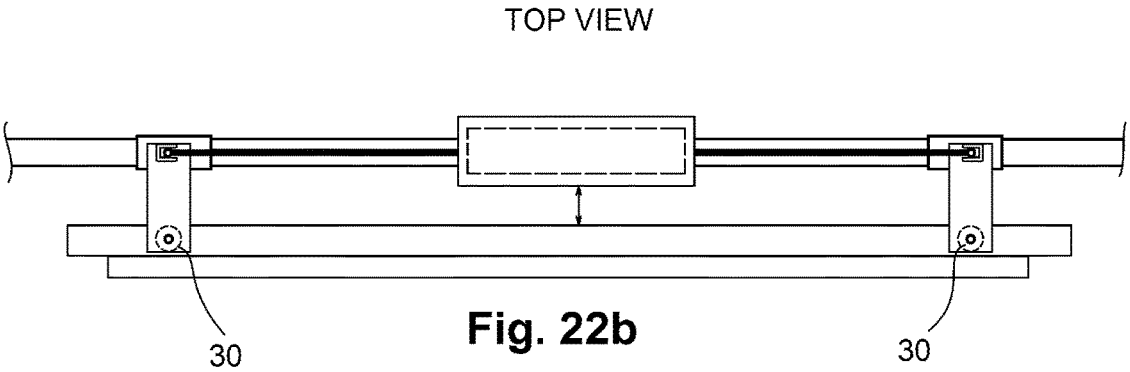

Each of FIGS. 20, 21 and 22 schematically illustrates a mechanism for distancing a sliding door from a rail, according to one embodiment of the invention.

It should be understood that the drawings are not necessarily drawn to scale.

DESCRIPTION OF EMBODIMENTS

The present invention will be understood from the following detailed description of preferred embodiments ("best mode"), which are meant to be descriptive and not limiting. For the sake of brevity, some well-known features, methods, systems, procedures, components, circuits, and so on, are not described in detail.

In the description herein, the terms "horizontal" and "vertical" refer to the ground.

As mentioned, it is an object of the present invention to provide a stepless sliding doors system, i.e., a sliding doors system in which upon closing the doors, the doors are situated in the same plane.

Figure 1A:
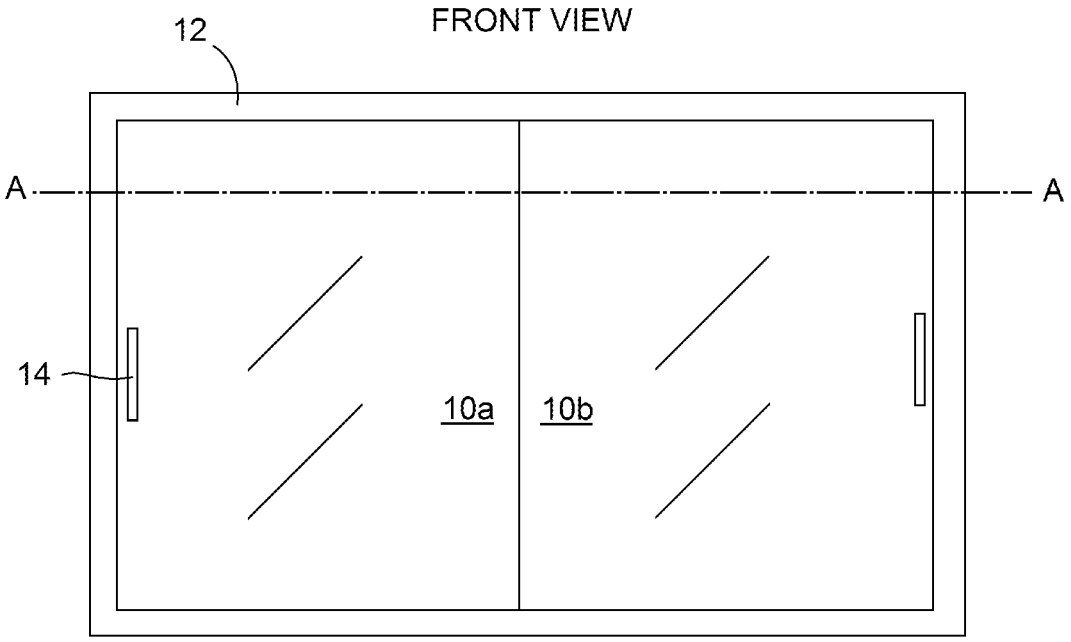
Fig. 1a Prior art
FIG. 1*a* is a front view which schematically illustrates a sliding doors system in a closed state, according to the prior art.
Figure 1B:
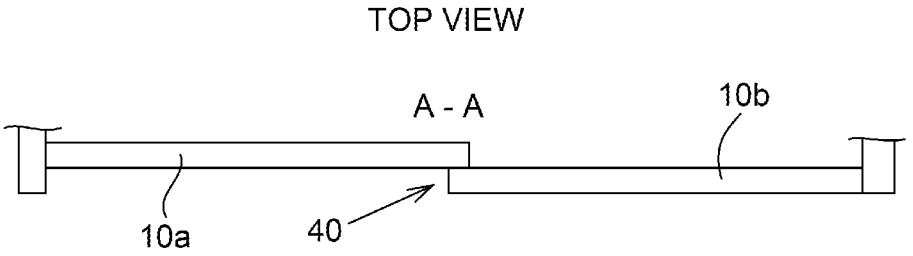
Fig. 1b Prior art
FIG. 1*b* is a top view which schematically illustrates the cross-section A-A of FIG. 1*a*.
Figure 2A:
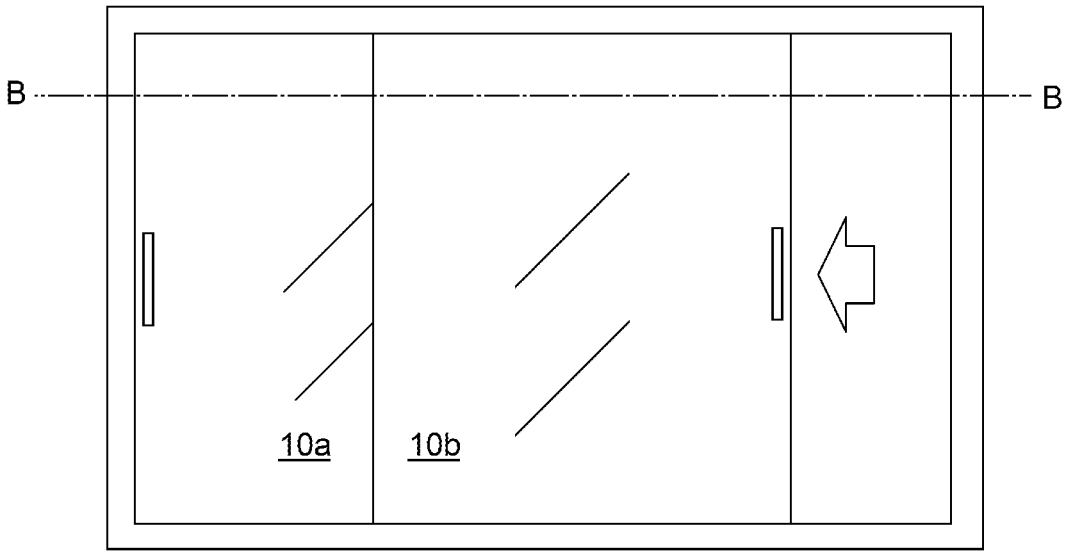
Fig. 2a Prior art
FIG. 2*a* is a front view which schematically illustrates the sliding doors system of FIG. 1 in an open state.
Figure 2B:
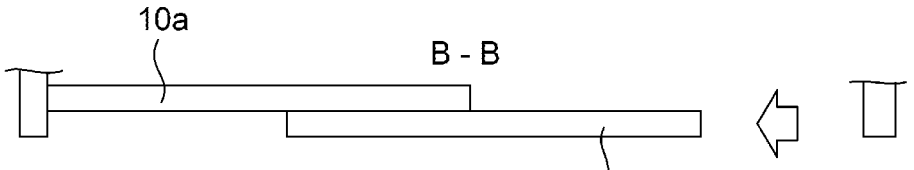
Fig. 2b Prior art
FIG. 2*b* is a top view which schematically illustrates the cross-section B-B of FIG. 2*a*.
Figure 3A:
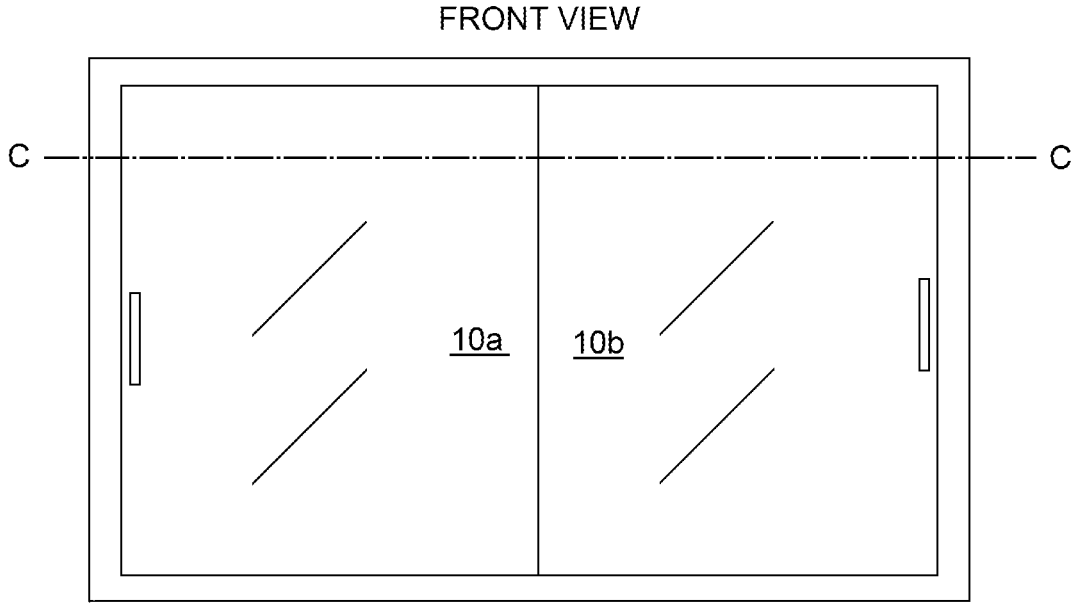
FIG. 3*a* is a front view which schematically illustrates a stepless sliding doors system, according to one embodiment of the invention.
Figure 3B:
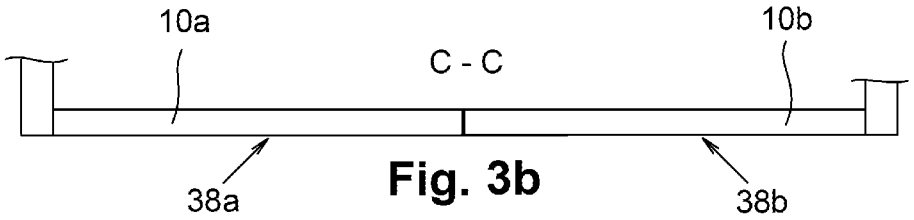
FIG. 3*b* is a top view which schematically illustrates the cross-section C-C of FIG. 3*a*.

FIG. 3*a* is a front view which schematically illustrates a sliding doors system, according to one embodiment of the invention. FIG. 3*a* also defines a cross-section C-C. FIG. 3*b* is a top view which schematically illustrates the cross-section C-C of FIG. 3*a*. Reference numeral 38*a* denotes the front panel of the left door 10*a*, and reference numeral 38*b* denotes the front panel of the right door 10*b*.

As can be seen in FIG. 3*b*, in the closed state of the sliding doors, the front panels 38*a* and 38*b* are situated in the same plane, i.e., without a "step".

Figure 3C:
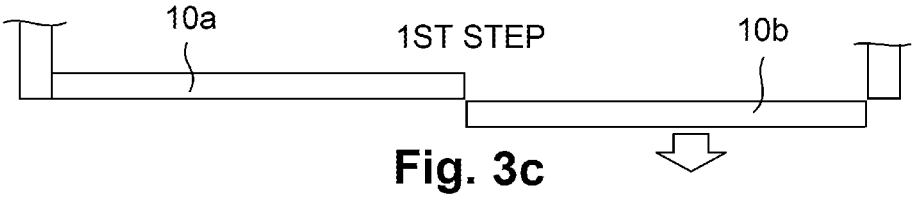
FIG. 3*c* is a cross-section that schematically illustrates the first step of opening the right door 10*b* of the sliding doors system of FIGS. 3*a* and 3*b*.

FIG. 3*c* is a cross-section that schematically illustrates the first step of opening the right door 10*b* of the sliding doors system of FIGS. 3*a* and 3*b*. In this step, the right door 10*b* is pushed outwards, until the lanes of the doors do not meet each other.

Figure 3D:
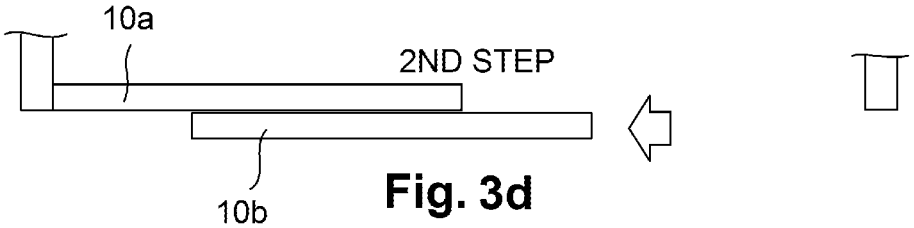
FIG. 3*d* is a cross-section that schematically illustrates the second step of opening the right door 10*b* of the sliding doors system of FIGS. 3*a* and 3*b*.

FIG. 3*d* is a cross-section that schematically illustrates the second step of opening the right door 10*b* of the sliding doors system of FIGS. 3*a* and 3*b*. In this step, the right door 10*b* is pushed leftwards. This is possible as the right door does not meet the left door.

Figure 4A:
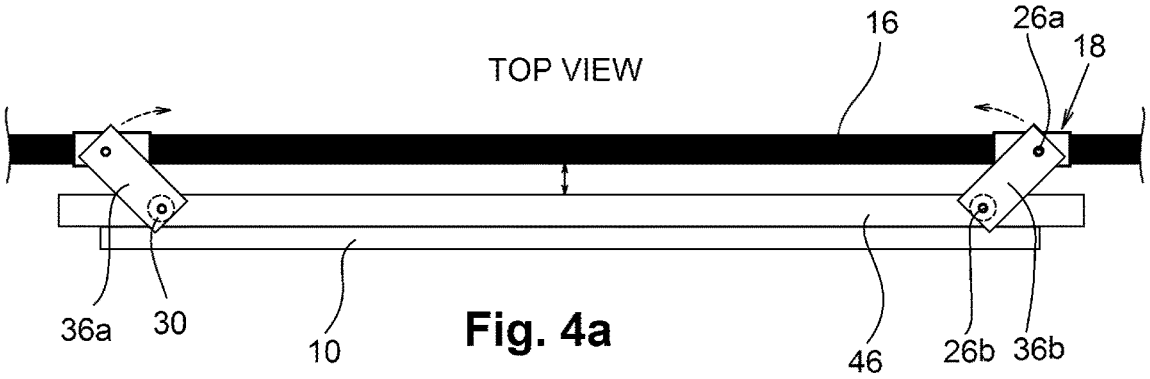
FIG. 4*a* is a top view which schematically illustrates the state of FIG. 3*b*.
Figure 4B:
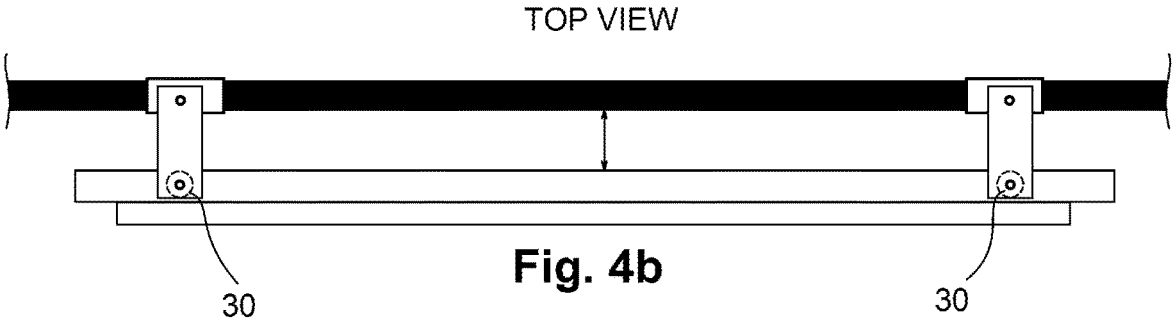
FIG. 4*b* is a top view which illustrates the state of FIG. 3*c*.
Figure 4C:
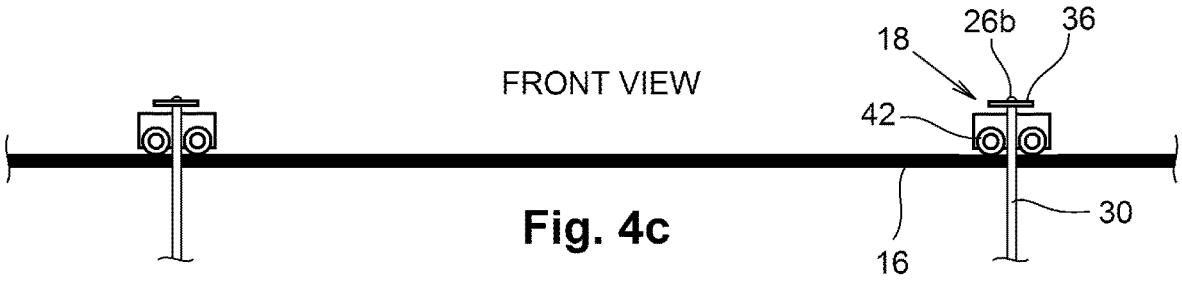
FIG. 4*c* is a front view thereof.

FIGS. 4*a*, 4*b* and 4*c* detail a mechanism for distancing a sliding door from a rail, according to one embodiment of the invention.

FIG. 4*a* is a top view which schematically illustrates the state of FIG. 3*b*, and FIG. 4*b* is a top view which illustrates the state of FIG. 3*c*. FIG. 4*c* is a front view thereof.

The mechanism comprises a chassis 46 which is firmly connected to a door 10. Also seen in these Figs. are vertical poles 30, the role of which is detailed hereinafter.

Each of the two hand-connectors 36*a* and 36*b* is pivotally connected in one end thereof by pivot 26*a* to a rail-cart 18, which rolls on rail 16. Each of the hand-connectors is firmly connected in the other end thereof to a vertical pole 30.

Thus, as the hand-connectors 36*i* (i=a, b) rotate simultaneously, the chassis distances from or approaches to the rail 16, according to the rotation direction.

In other words, upon simultaneously rotating hand-connectors 36*a* and 36*b* in one direction, the door 10 distances from the rail until reaching the state described in FIG. 4*b*; and upon simultaneously rotating the hand-connectors 36*a* and 36*b* in opposite directions, the door 10 approaches to the rail as illustrated in until reaching the situation illustrated in FIG. 4*a*.

It should be noted that one of the pivots of a hand-connector 36*i* (i=a, b) may be replaced by a ball joint (not illustrated in these figures), thereby providing adjustability of the system to a vertical deformation of the rail.

Additionally, it should be noted that employing two rollers 42 on each of the rail-carts 18 provides horizontal adjustability of the rail-cart 18 along the rail. The fact that one roller is distant from the other provides an increased moment for horizontally turning the rail-cart.

Figure 5A:
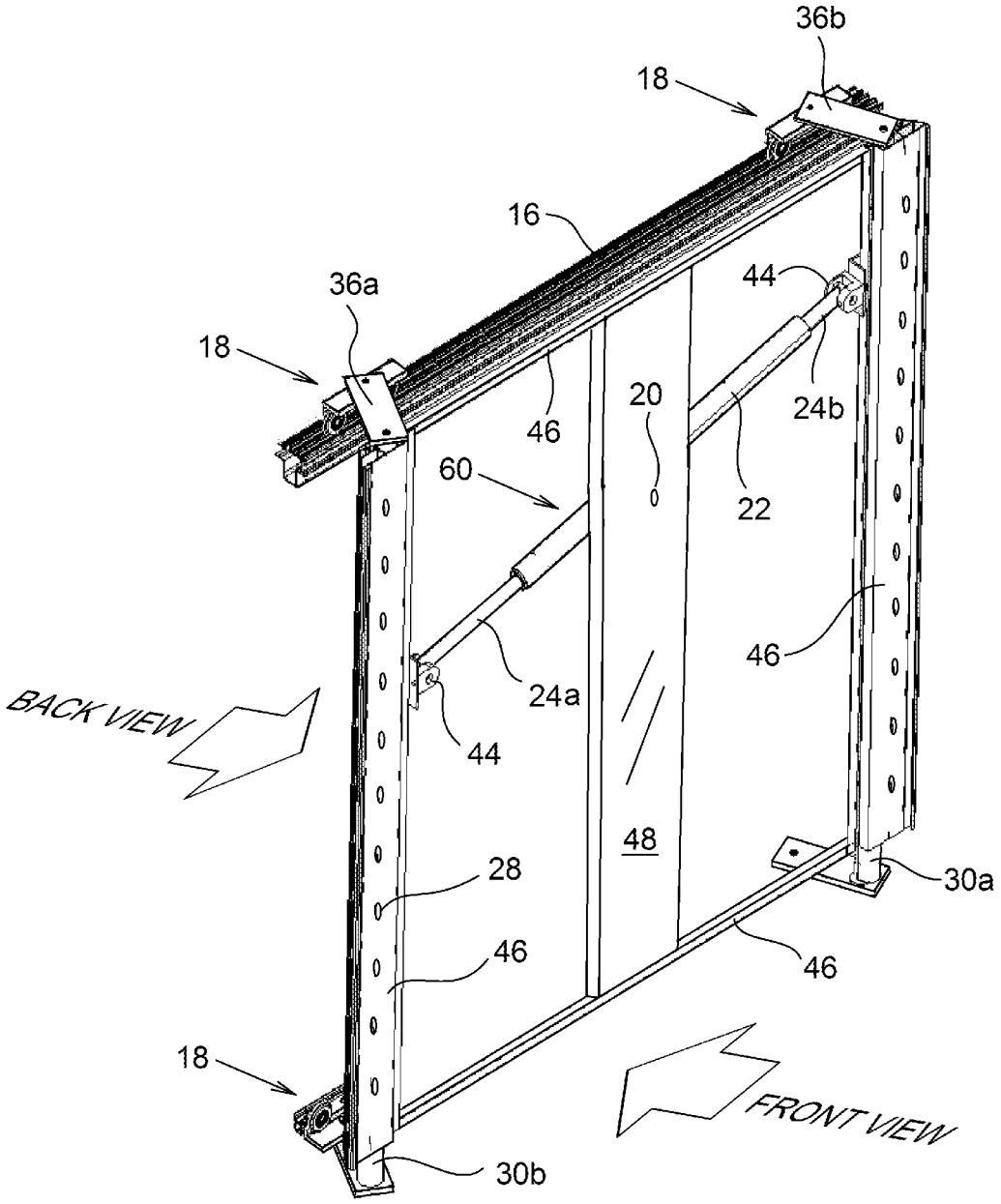
FIG. 5*a* is a perspective view of a mechanism for distancing and approaching a sliding door, according to one embodiment of the invention.
Figure 5B:
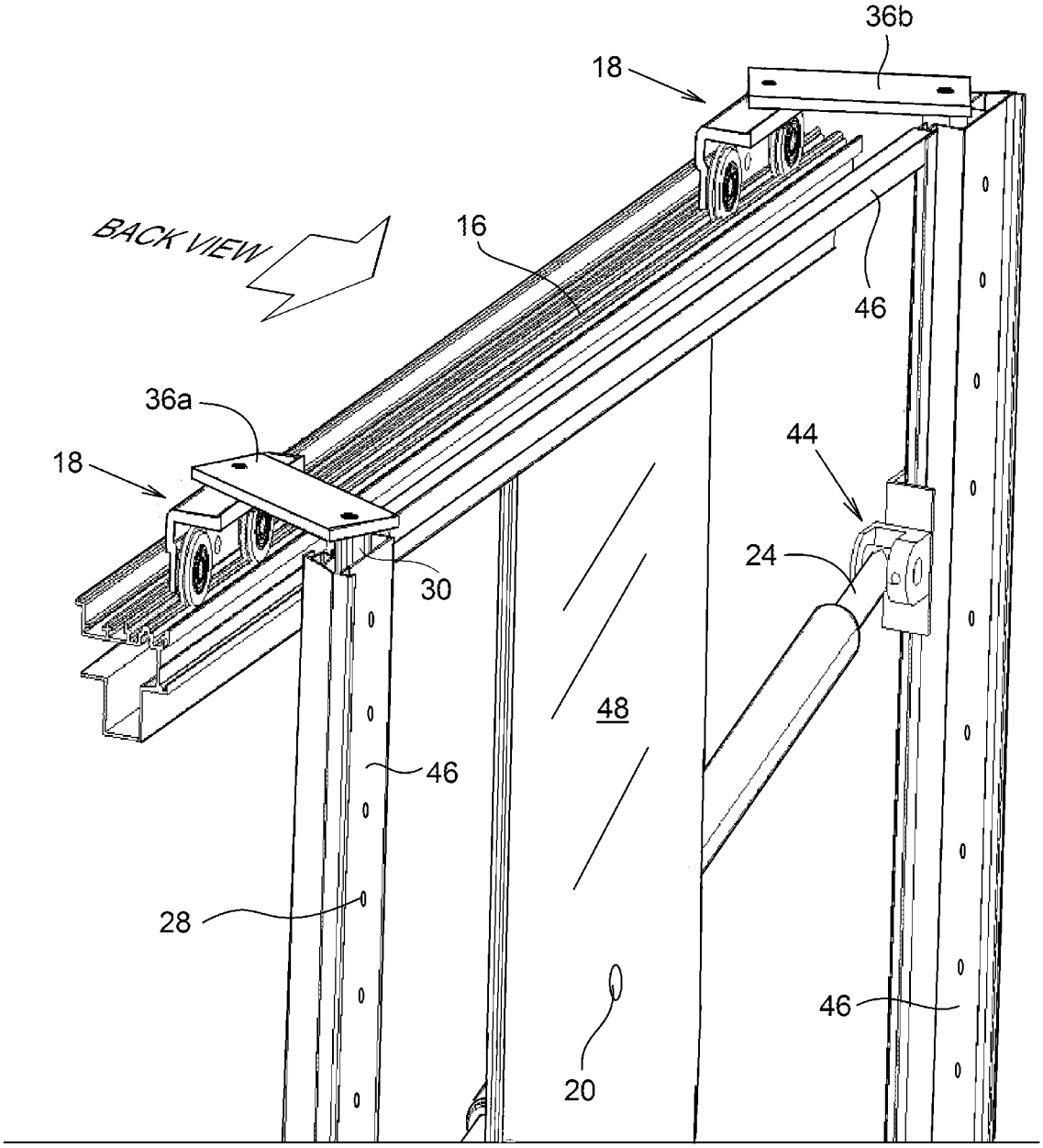
FIG. 5*b* is a zoomed view thereof.

FIG. 5*a* is a perspective view of a mechanism for distancing and approaching a sliding door, according to one embodiment of the invention. FIG. 5*b* is a zoomed view thereof.

For the sake of brevity the door is not illustrated.

The mechanism comprises a chassis 46 which in this case is in the form of a frame. The chassis 46 is connected to a sliding door by bolts (not illustrated) through bores 28.

Of course, the bores and corresponding bolts are merely a simple example of connection means, and other connection means may be used, such as mating profiles, and the like.

Also seen in these figures, each of the hand-connectors 36*a* and 36*b* is disposed at opposite sides of the door/chassis.

Reference numeral 60 denotes a telescopic rod. The telescopic rod comprises tube 22, and two shafts 24*a* and 24*b*, each at an opposite side of tube 22. Each of the shafts 24*a*, 24*b* is pivotally connected to a nut (not seen in this figure) by a pivot connection 44.

The telescopic rod 60 is pivotally connected to the chassis 46. More particularly, in the illustrated example a hinge 20 connects the telescopic rod 60 to a bar 48 which is firmly connected to the frame of chassis 46, or is a part of it.

It should be noted that for the sake of brevity, in FIG. 5*a* the right lower rail-cart 18 is not illustrated. Additionally, a part of the lower rail 16 is not illustrated as well.

Figure 6:
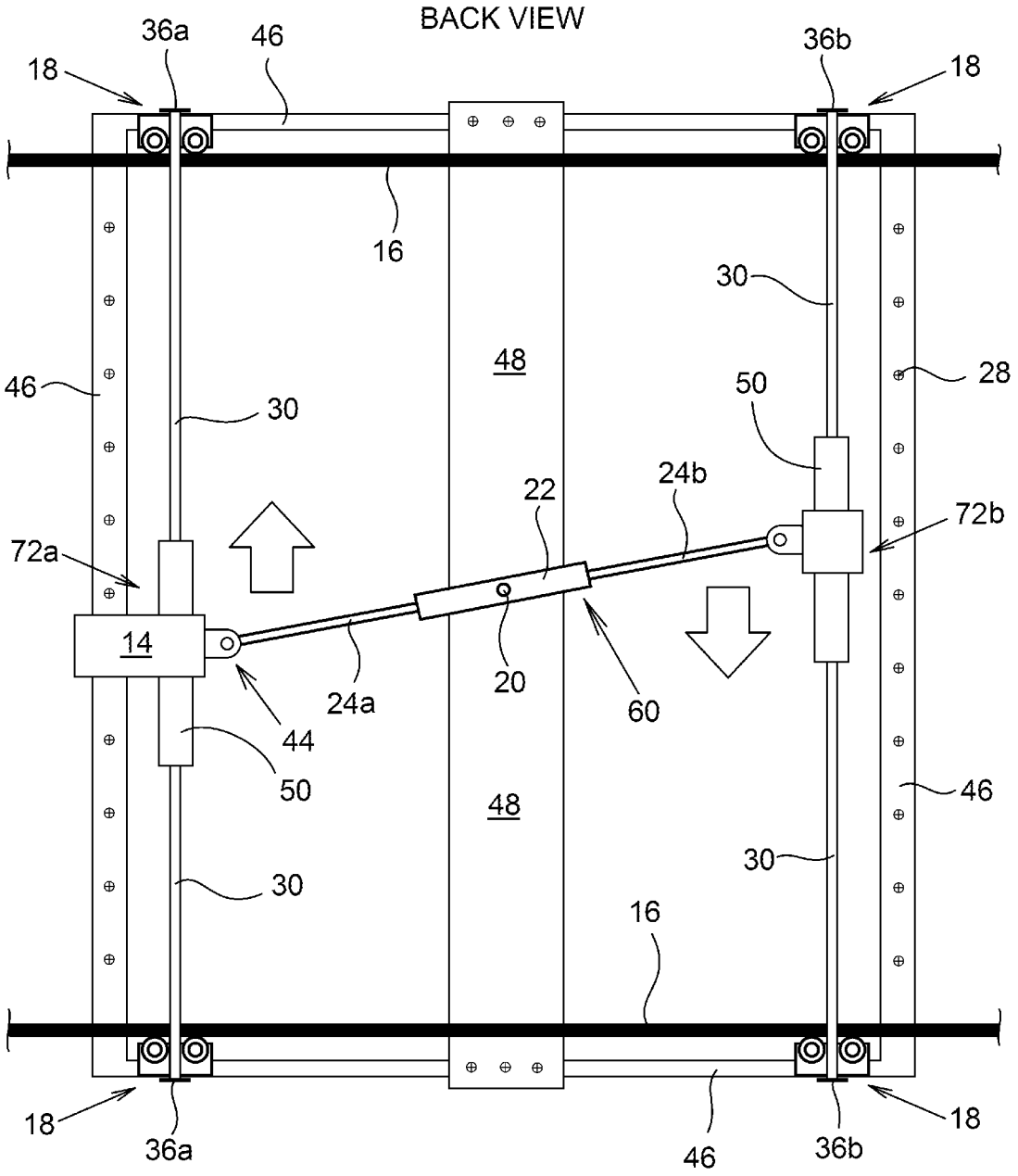
FIG. 6 is a back view which comprehensively illustrates a mechanism for distancing and approaching a sliding door, according to one embodiment of the invention.

FIG. 6 is a back view which comprehensively illustrates a mechanism for distancing and approaching a sliding door, according to one embodiment of the invention.

The mechanism employs a chassis 46 to which a sliding a door is connected.

Two parallel rails 16 are employed, an upper rail and a lower rail. In the examples herein the chassis hangs on the rails, i.e., the load of the door is on the upper rail, while the lower rail is used to prevent the door from swinging. However, it should be noted that the load can be on the lower rail, while the upper rail is used for preventing the upper side of the door from swinging.

Two spiral rotation assemblies 72*a* and 72*b* are employed. Such spiral rotation mechanism uses a vertically shiftable tube 50, and a corresponding vertical pole 30. Upon vertically shifting tube 50 upwards, pole 30 rotates in one direction; upon vertically shifting tube 50 downwards, pole 30 rotates in the opposite direction. The structure of the spiral rotation assemblies is detailed in FIGS. 17 and 18.

Each of the vertical poles 30 is firmly connected in one end thereof to a hand-connector 36*i* (i=a, b), and pivotally connected in the other end thereof to a rail-cart 18. As such, shifting one of the vertically shiftable tubes 50 causes the corresponding vertical pole 30 to rotate. The rotation of pole 30 distances or approaches the corresponding rail-carts from the chassis.

In order to simultaneously distance/approach the two pairs of rail-carts from/to the chassis, the rotation of the vertical poles 30 has to be simultaneous. FIG. 6 illustrates such a mechanism.

Attention is drawn now to the telescopic rod 60 which comprises a tube 22 and shafts 24*a* and 24*b*, each pivotally connected to a vertically shiftable tube 50. The shafts 24*a* and 24*b* are different entities, i.e., each of the shafts operates independently from the other. The structure of the telescopic rod 60 is detailed in FIG. 11 and the description thereof.

Tube 22 is pivotally connected by hinge 20 to the bar 48 which is firmly connected to the chassis 46. As such, upon pushing the left vertically shiftable tube 50 upwards, the other vertically shiftable tube 50 is pushed downwards, and vice versa. This mechanism causes the hand-connectors 36*a* and 36*b* to rotate simultaneously in opposite directions. The simultaneous rotation causes the chassis 46 to approach at a distance from the rails according to the rotation direction, while remaining parallel to the rails.

Figure 7:
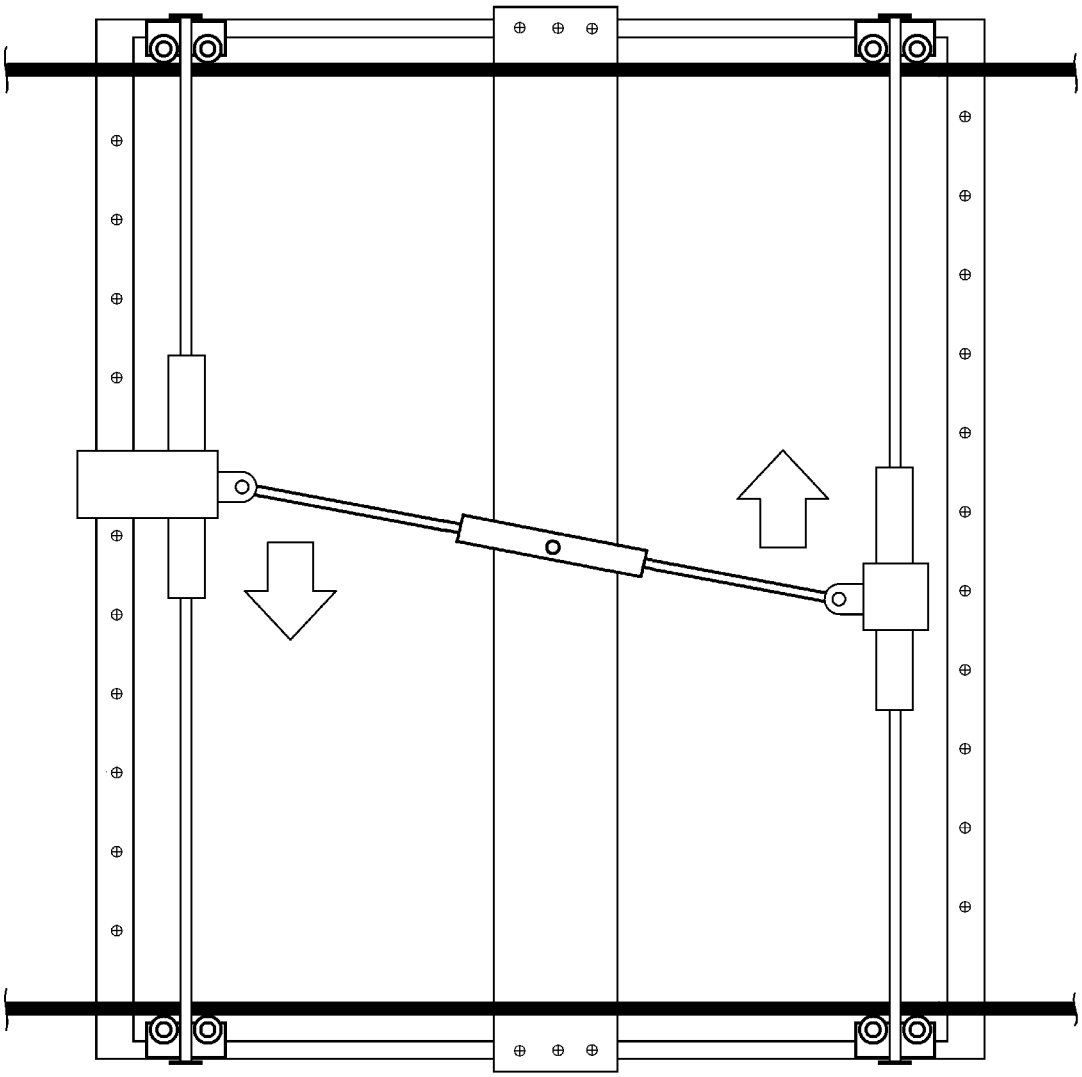
FIG. 7 illustrates the mechanism of FIG. 6, wherein the handle has been pushed upwards.

FIG. 7 illustrates the mechanism of FIG. 6, wherein the handle has been pushed upwards.

Figure 8:
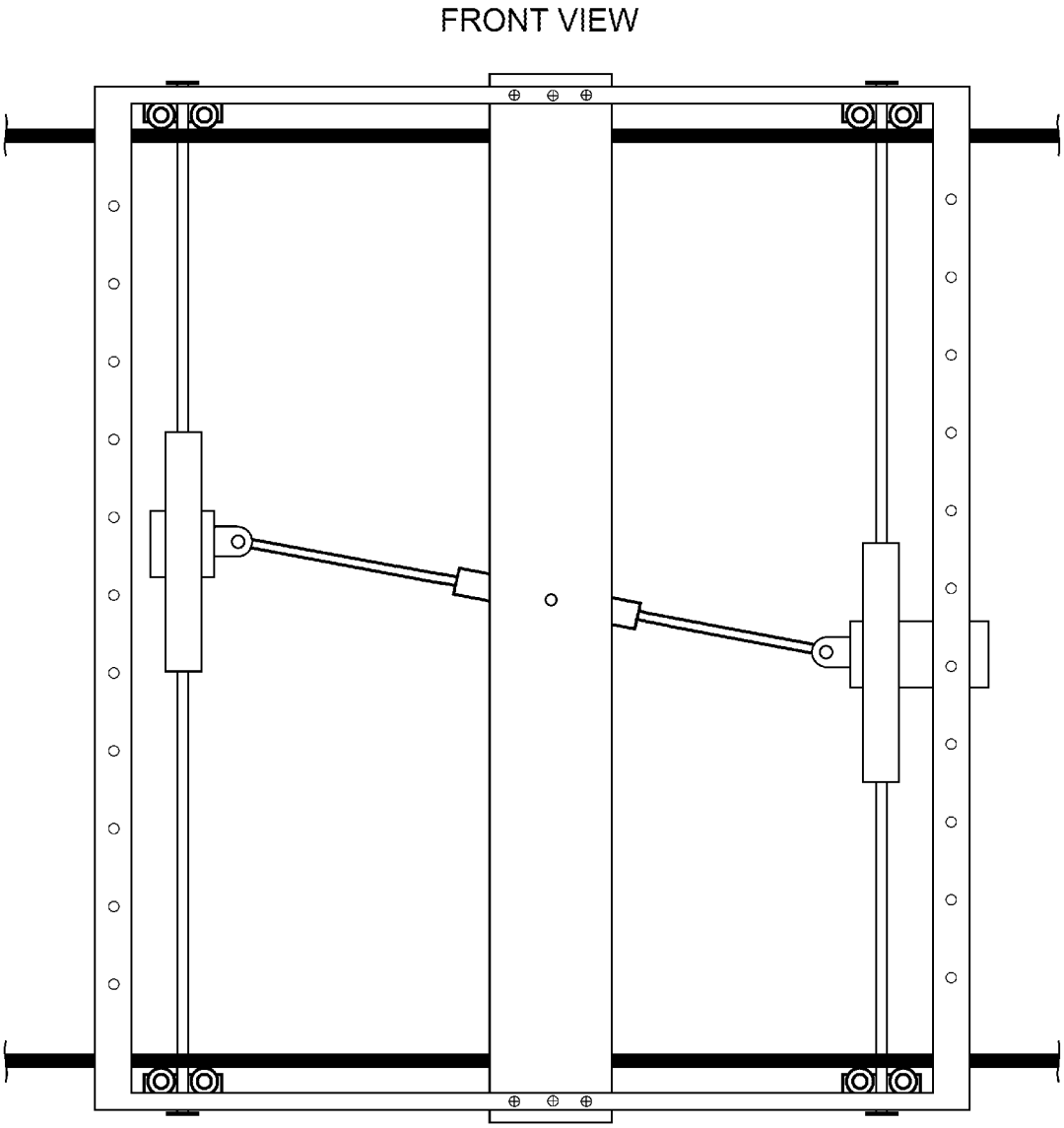
FIG. 8 is a front view of the mechanism of FIG. 6.

FIG. 8 is a front view of the mechanism of FIG. 6.

Figure 9:
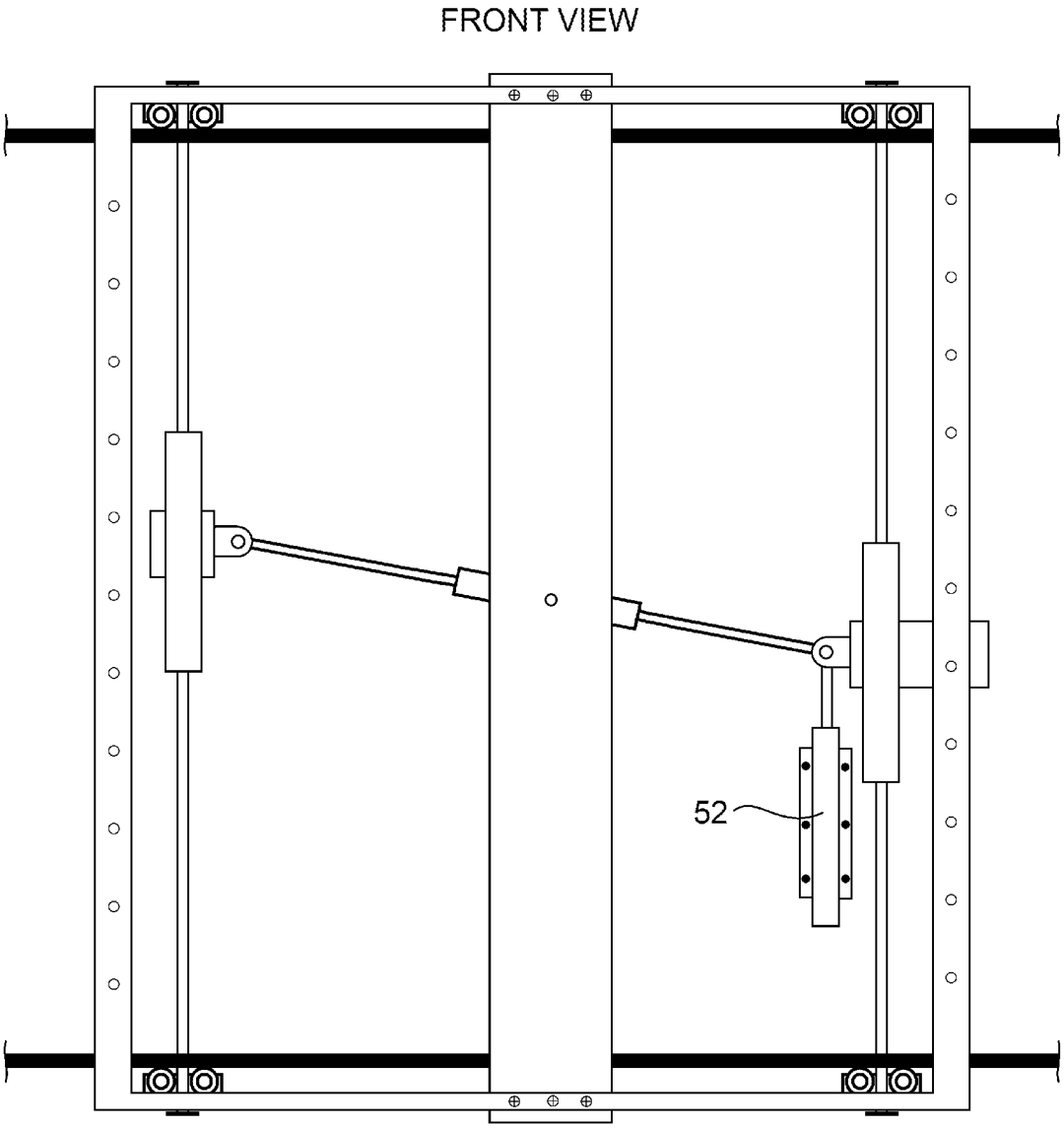
FIG. 9 is a back view which comprehensively illustrates a mechanism for distancing and approaching a sliding door, according to a further embodiment of the invention.

FIG. 9 is a back view which comprehensively illustrates a mechanism for distancing and approaching a sliding door, according to a further embodiment of the invention.

According to this embodiment of the invention, a motor 52 is used for shifting the nut of one side upwards and downwards. The motor can be operated by buttons on the handle. A controller (not illustrated) that operates the motor can be programmed to make a required move. Alternatively, limit switches (not illustrated) can be placed in the handle's lane in order to stop the moving upwards and downwards at desired points.

The motor can be attached to the chassis by an additional vertical bar (not illustrated) and the like.

Figure 10:
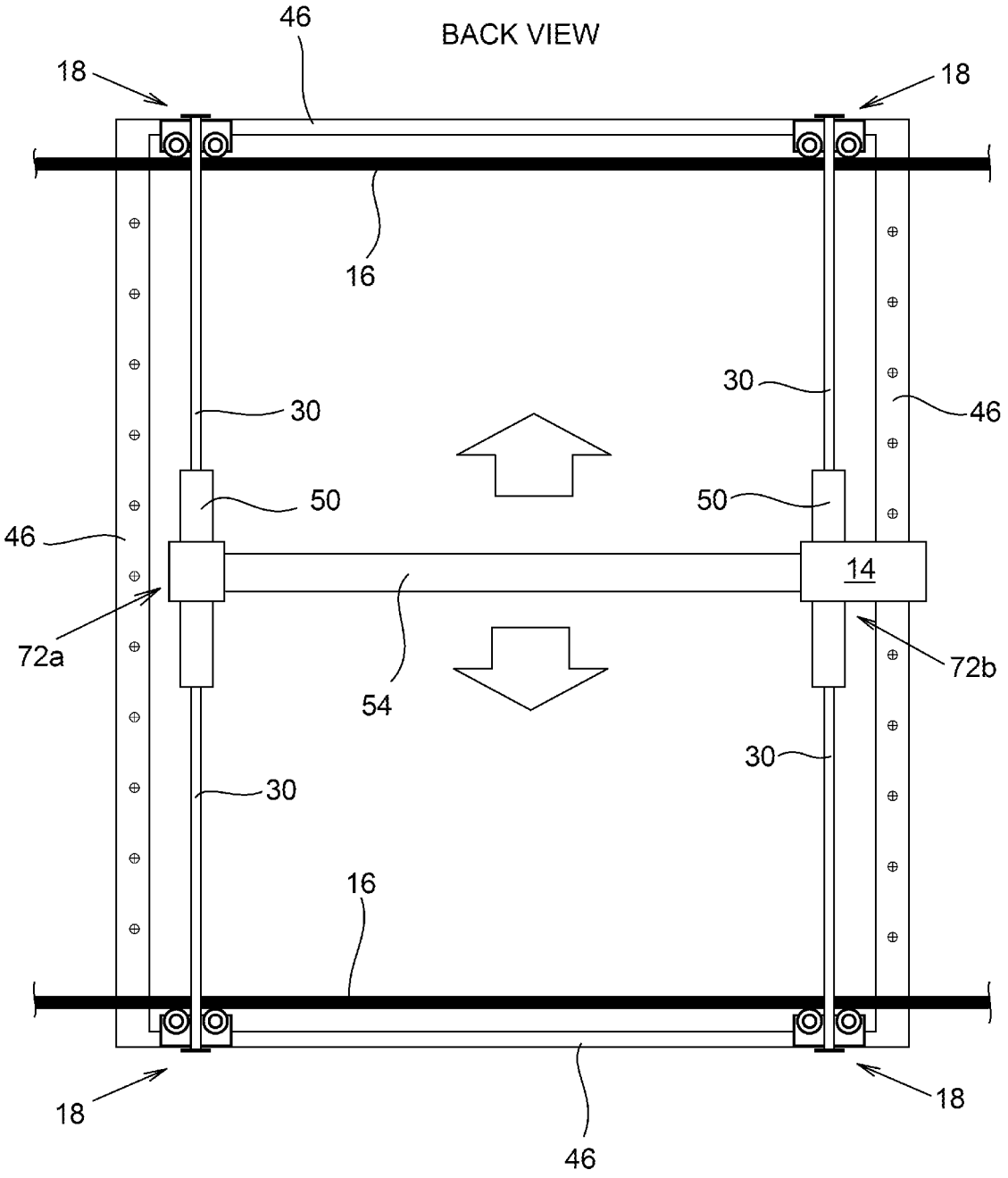
FIG. 10 is a back view which comprehensively illustrates a mechanism for distancing and approaching a sliding door, according to another embodiment of the invention.

FIG. 10 is a back view which comprehensively illustrates a mechanism for distancing and approaching a sliding door, according to another embodiment of the invention.

According to this embodiment of the invention, a horizontal bar 54 firmly connects vertically shiftable tube 50*a* to vertically shiftable tube 50*b*. Thus, by vertically shifting handle 14, the chassis 46 approaches or distances from rail 16, and as the door is connected to the chassis, it approaches or distances from the rail, thereby allowing shifting the door as illustrated in FIG. 3*d*.

When employing a motor (not illustrated in this figure), it is preferably used to push/pull the center of the horizontal bar 54.

Figure 11:
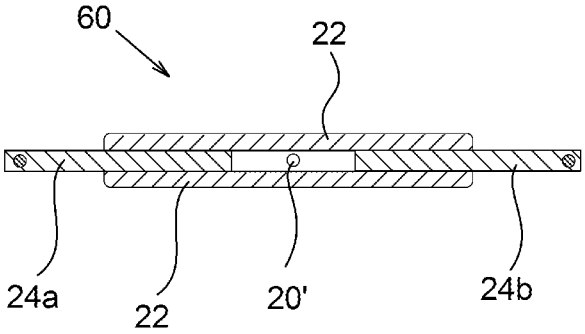
FIG. 11 schematically illustrates a telescopic rod, used in embodiments of the present invention.

FIG. 11 schematically illustrates a telescopic rod, used in embodiments of the present invention.

Reference numeral 22 denotes a tube. In one end of the tube is disposed a first shaft 24*a*, and in the other end is disposed a second shaft 24*b*.

Reference numeral 20' is a bore in which is disposed a hinge.

Figure 12:
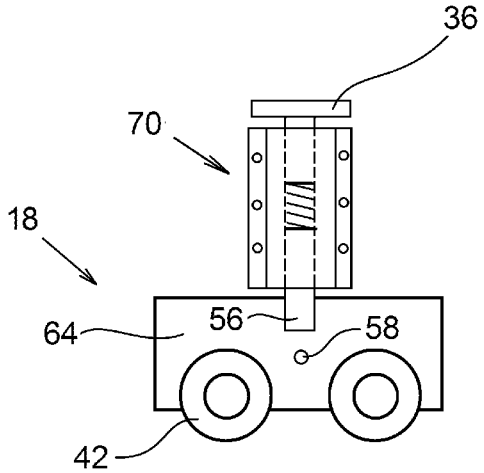
FIG. 12 is a front view schematically illustrating a rail-cart, according to one embodiment of the invention.

FIG. 12 is a front view schematically illustrating a rail-cart, according to one embodiment of the invention.

The cart comprises a vertical springy hinge 70, and a horizontal hinge 58. These elements provide gyroscopic connection of the hand-connector 36 to the rail (not illustrated in this figure).

The gyroscopic connection is used as means for overcoming on slight deformation of the rail. Such a deformation may be a defect in the production, or a bend which happens over time as a result of the load on the rail. The deformation may be horizontal as well as vertical.

Figure 13:
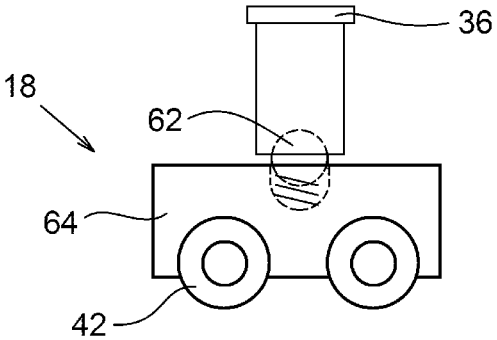
FIG. 13 is a front view schematically illustrating a rail-cart, according to another embodiment of the invention.

FIG. 13 is a front view schematically illustrating a rail-cart, according to another embodiment of the invention.

The dashed lines denote a hidden part.

According to this embodiment, a ball bearing 62 replaces the vertical and horizontal axles of the embodiment of FIG. 12.

Thus, in both cases the hand-connector 36 is gyroscopically connected to the rail (not illustrated in these figures).

As in the embodiment of FIG. 12, the gyroscopic connection provides means for overcoming a slight deformation of the rail. Such a deformation may be a defect in the production, or a bend which happens over time as a result of the load on the rail. The deformation may be horizontal as well as vertical.

Each of FIGS. 14*a*, 14*b*, 14*c*, 15*a*, 15*b*, 15*c* and 16 schematically illustrates a state of a rail-cart assembly of a stepless sliding doors system, according to one embodiment of the invention.

FIGS. 14*a*, 14*b*, 14*c*, 15*a*, 15*b* and 15*c* are sectional views. FIG. 16 is an isometric view.

Figure 14A:
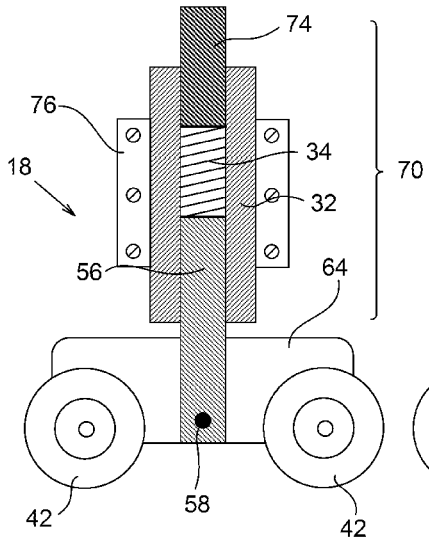
FIGS. 14*a*, 14*b*, 14*c*, 15*a*, 15*b* and 15*c* are sectional views of a rail-cart, according to one embodiment of the invention.
Figure 14B:
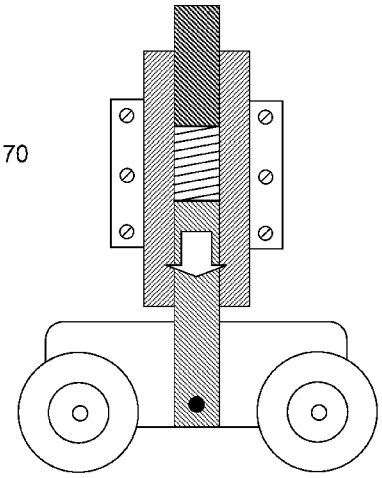
Figure 14C:
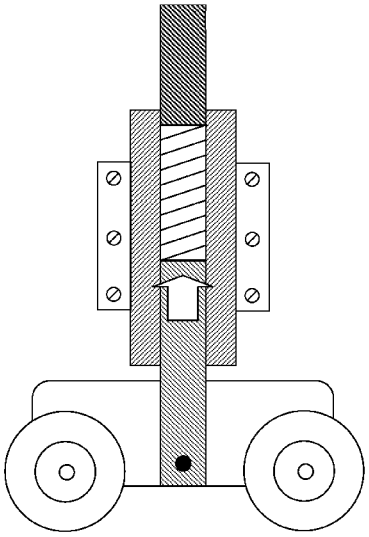
Figure 15A:
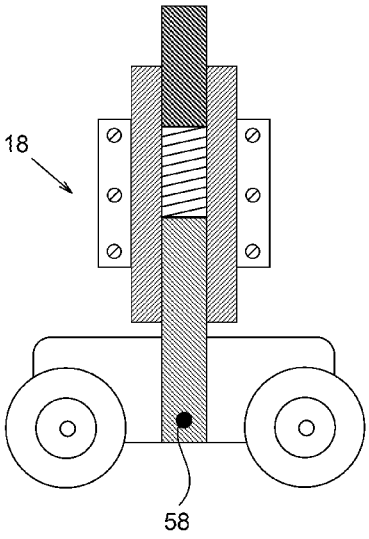
Figure 15B:
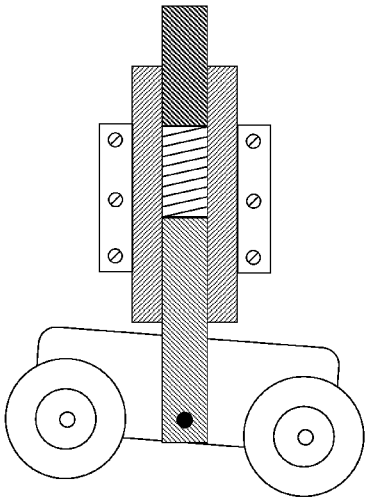
Figure 15C:
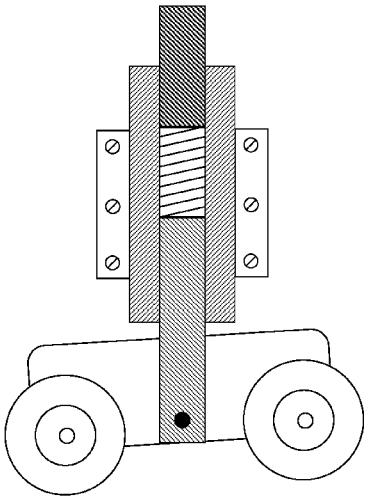
Figure 16:
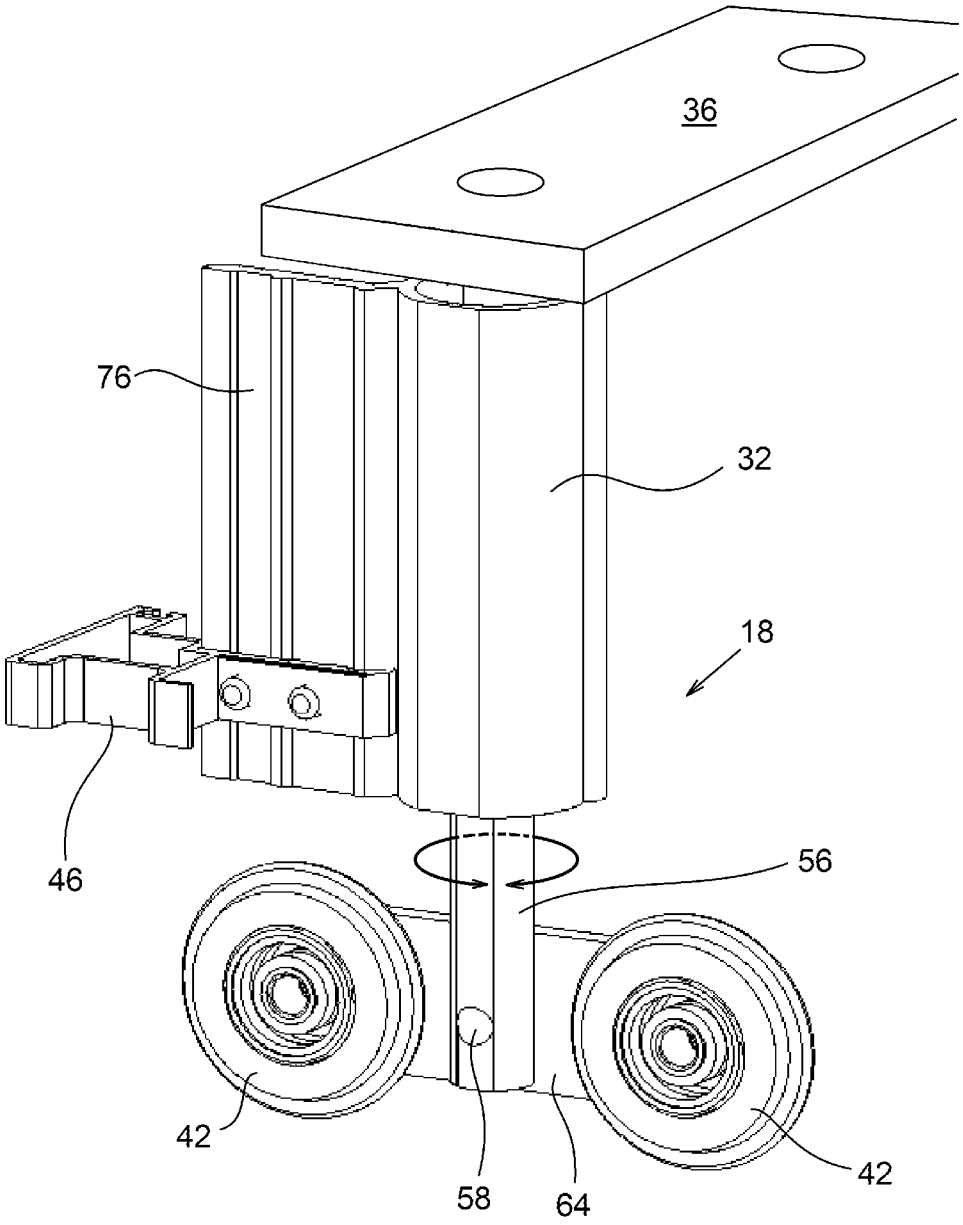
FIG. 16 is an isometric view thereof.

The rail-cart assembly, which is marked herein by reference numeral 18, has several movement abilities:

- a rotational movement along a vertical axis, as illustrated by the arrow in FIG. 16;
- a "swinging" movement along horizontal hinge 58, as illustrated in FIGS. 15*a*, 15*b* and 15*c*; and
- a vertical shifting movement along a vertical axis, as illustrated in FIGS. 14*a*, 14*b* and 14*c*.

As per the rail-cart structure, it comprises:

- a vertical springy hinge 70, comprising:
  - a vertical tube 32;
  - a vertical rod 56 disposed in tube 32;
  - a spring 34, for applying pulling or pushing force on the vertical rod 56;
  - setting means 74, for setting an operation of the spring 34 to push or pull the vertical rod 56; and
  - fixing means 76, for fixing the vertical springy hinge 70 to the chassis 46;
- a base 64;
- a horizontal hinge 58, for pivotally connecting the vertical hinge 70 to the base 64;
- two rollers 42 pivotally connected to the base 64 by the horizontal hinge 58 from each side of the horizontal hinge.

The setting means 74 may be, for example, a screw threaded into tube 32.

As a result of this structure, the ability of the rail-cart 18 to stay on a rail 16 in the case of horizontal and/or vertical deformations of the rail is increased.

Referring to FIG. 6, the upper rail-carts support the weight of the sliding door, while the lower rail-carts are used for retaining the lower side of the door on the lower rail.

In FIG. 14*a* is illustrated an idle situation, i.e., the spring is not tensed. In FIG. 14*c* the spring 34 pulls the wheels upwards and as such in this configuration the rail-cart is suitable to be placed at the lower side of the door of FIG. 6.

In FIG. 14*b*, the spring 34 is squeezed, and as such it pushes the wheels downwards, and as such in this configuration the rail-cart is suitable to be placed at the upper side of the door of FIG. 6.

Thus, the rail-cart assembly is rotatable along a vertical axis, swingable along a horizontal axis, and shiftable along the vertical axis.

FIG. 16 is an isometric view of a rail-cart 18, according to one embodiment of the invention.

It illustrates the base 64 of the rail-cart to which rollers 42 are pivotally connected. The vertical rod 56 is pivotally connected to the base 64 of the rail-cart by a hinge 58. Reference numeral 76 denotes a sleeve in which tube 32 (not seen in this figure) is disposed. Profile 76 is used for connecting the tube 32 to the chassis 46. The chassis is illustrated in a sectional view.

Figure 17:
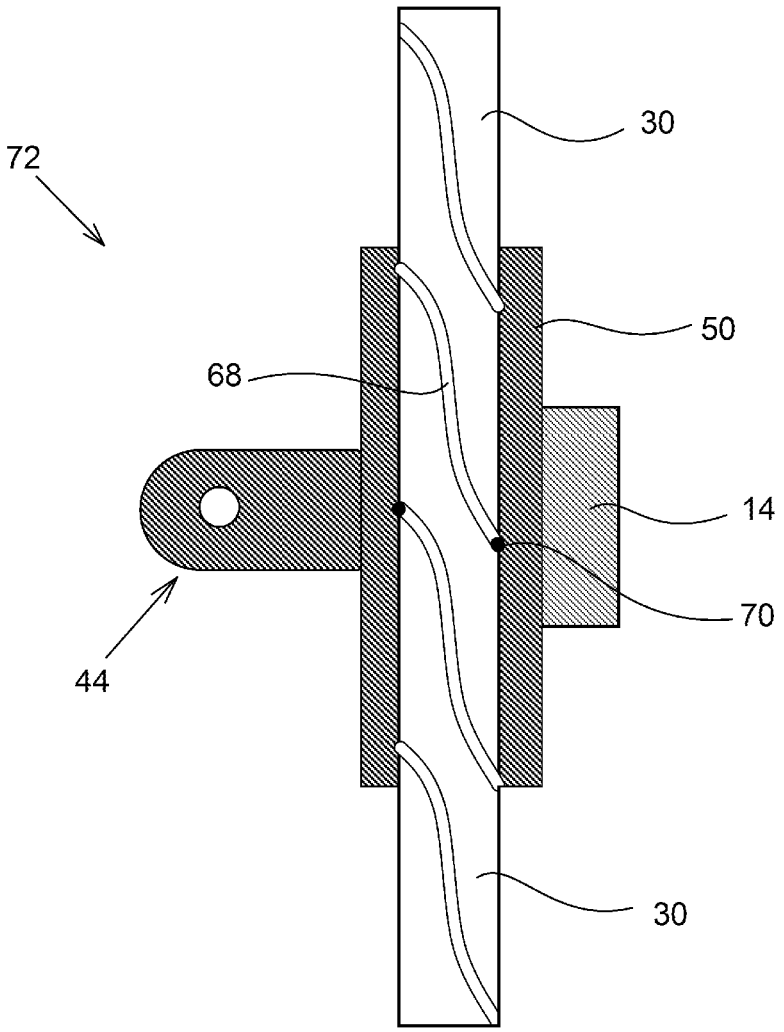
FIG. 17 is a sectional view of a spiral rotation assembly 72*a*, according to one embodiment of the invention.

FIG. 17 is a sectional view of a spiral rotation assembly 72, according to one embodiment of the invention.

Pole 30 comprises a spiral groove 68. The pole 30 is disposed in a vertically shiftable tube 50. A tenon 78 is connected in one end thereof to vertically shiftable tube 50, while the other end thereof is disposed into the spiral groove 68. A handle 14 is connected to vertically shiftable tube 50.

Thus, upon shifting the vertically shiftable tube 50 upwards, pole 30 rotates in one direction; and upon shifting the vertically shiftable tube 50 downwards, pole 30 rotates in the opposite direction. The spiral grooves are directed to rotate pole 30 by 90 degrees.

Figure 18:
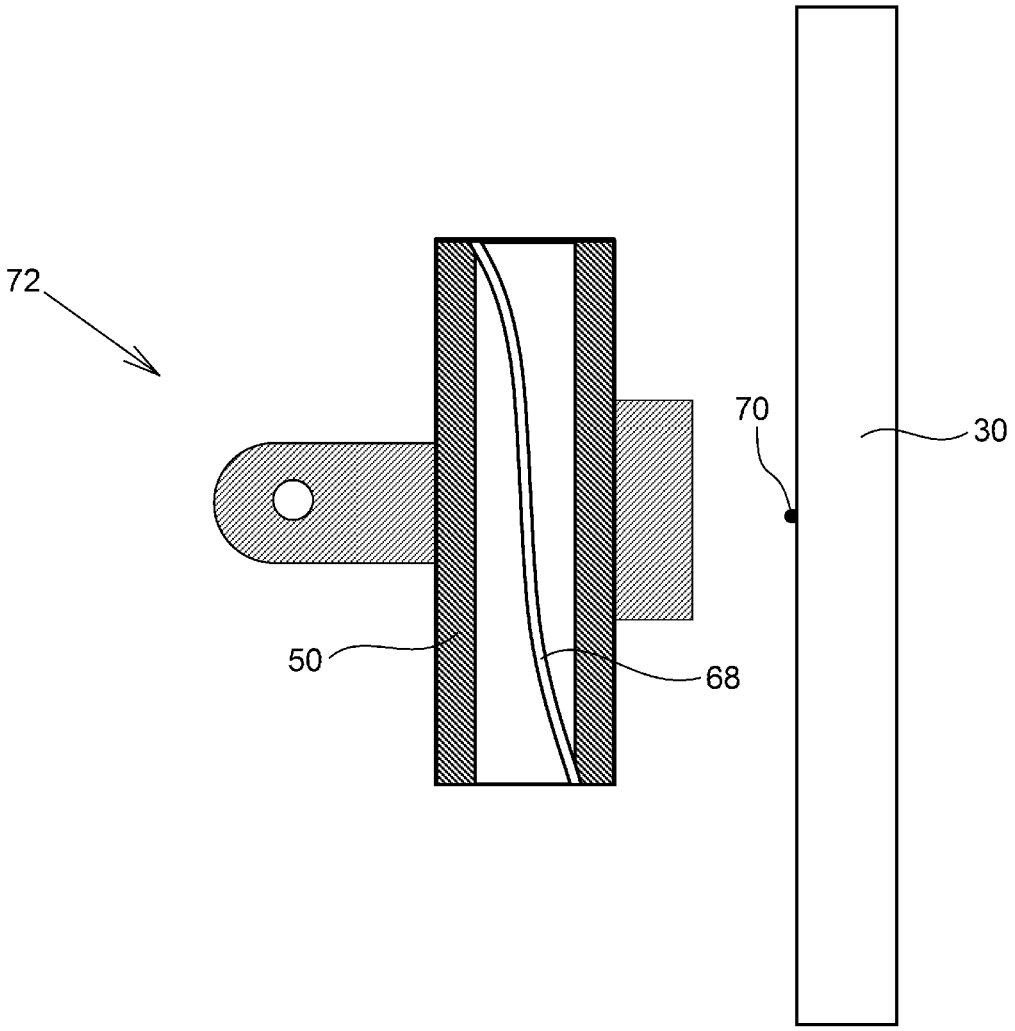
FIG. 18 is a sectional view of a spiral rotation assembly 72*a*, according to another embodiment of the invention.

FIG. 18 is a sectional view of a spiral rotation assembly 72, according to another embodiment of the invention.

In this case, the grooves 68 are on the inner side of vertically shiftable tube 50, while tenon 78 is connected to pole 30.

For the sake of brevity, pole 30 is illustrated apart from the inner side of vertically shiftable tube 50.

Figure 19:
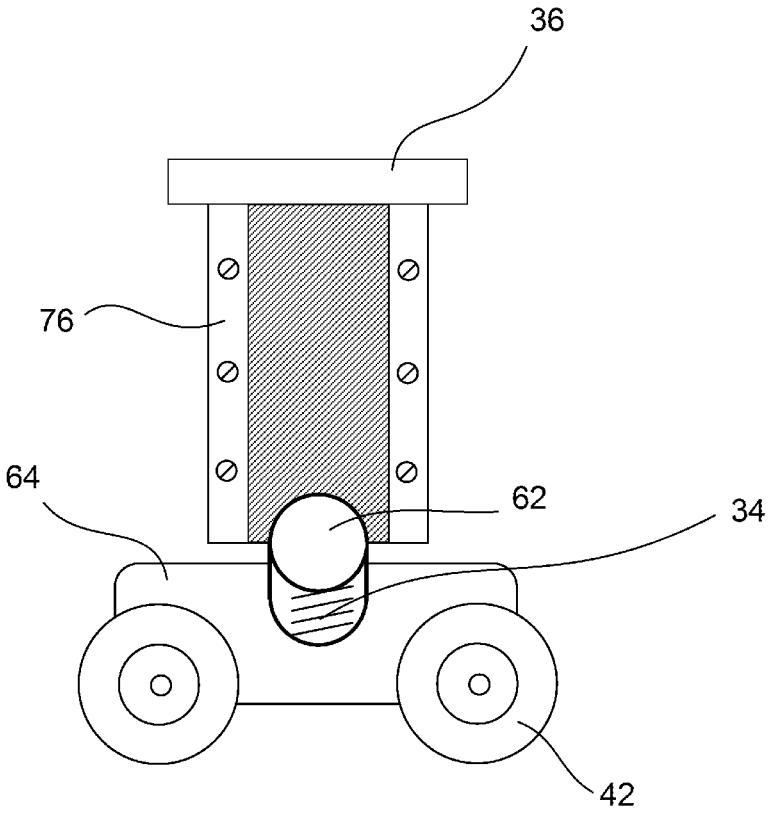
FIG. 19 is a sectional view schematically illustrating a rail-cart 18, according to another embodiment of the invention.

FIG. 19 is a sectional view schematically illustrating a rail-cart 18, according to another embodiment of the invention.

The rail-cart 18 comprises a base 64, and a ball bearing 62 connecting the base 64 to a hand-connector 36. Additionally, the rail-cart 18 comprises a spring 34. The spring 34 can be set to push the base 64 away from the hand-connector 36, or to pull the base to the hand-connector 36.

This structure increases the ability of the rollers (42) to stay on a rail (16) in the case that the rail has slight deformations.

Each of FIGS. 20, 21 and 22 schematically illustrates a mechanism for distancing a sliding door from a rail, according to one embodiment of the invention.

According to this embodiment of the invention, this mechanism does not employ a spiral rotation assembly.

The mechanism employs a telescopic rod comprising a tube 84, two poles 82*a* and 82*b*, and a motor 80 disposed in tube 84. The motor's role is to approach/distance poles 82*a* and 82*b* to/from each other. The poles 82*a* and 82*b* are pivotally connected to pivot connectors 86*a* and 86*b* correspondingly; and each of the pivot connectors 86*a* and 86*b* is connected to pivot 26*a* (seen inter alia in FIGS. 4*a* and 4*b*).

Thus, the rotation movement of hand connectors 36*a* and 36*b* causes a simultaneous rotation of hand connectors 36*a* and 36. As such, this mechanism replaces the spiral rotation assembly of the other embodiments illustrated in FIGS. 5 and 10.

Nevertheless, when a spiral rotation mechanism is employed, the mechanism is more massive than without the spiral rotation mechanism, as the simulations rotation of poles 30 is caused due to the distancing/approaching of connectors 84*a* and 84 caused by the motor, and also the operation of the spiral rotation assembly.

The motor 80 may be an electric motor, a step motor, and so on. A use of limit switches can be made for limiting its movement. Alternatively, a controller can be used.

In the figures and/or description herein, the following reference numerals (Reference Signs List) have been mentioned:

each of numerals 10, 10*a*, 10*b* denotes a sliding door;
numeral 12 denotes a closet frame;
numeral 14 denotes a handle of a sliding door;
numeral 16 denotes a rail;
numeral 18 denotes a rail-cart;
numeral 20 denotes a hinge of a telescopic rod 60;
numeral 20' is a bore in which is disposed hinge 20;
numeral 22 denotes a tube of a telescopic rod;
numeral 24*i* (i=a, b) denotes a shaft of a telescopic rod;
each of numerals 26, 26*a*, 26*b* denotes a pivot for connecting a hand-connector 36, 36*a*, 36*b* to a rail-cart 18;
numeral 28 denotes a bore through which a corresponding bolt connects the chassis 46 to a door, as an example of connection means;
numeral 30 denotes a vertical pole;
numeral 32 denotes a vertical tube of a vertical hinge;
numeral 34 denotes a spring of hinge 56;
each of numerals 36, 36*a*, 36*b* denotes a hand-connector;
each of numerals 38*i* (i=a, b) denotes a front panel of a sliding door;
numeral 40 denotes a "step", i.e., two front panels which are not situated in the same plane;
numeral 42 denotes a rail-cart roller;
numeral 44 denotes a pivot connection by which a shaft 24*i* (i=a, b) connects to a vertically shiftable tube (50*a*, 50*b*);
numeral 46 denotes a chassis;
numeral 48 denotes a bar firmly connected to the chassis 46, or being a part of the chassis;
each of numerals 50, 50*a* and 50*b* denotes a vertically shiftable tube, as an example of means for rotating a vertical pole 30;
numeral 52 denotes an electric motor which pushes and pulls the handle upwards and backwards;
numeral 54 denotes a horizontal bar which firmly connects vertically shiftable tube 50*a* to vertically shiftable tube 50*b*, as an example of a transverse rod;
numeral 56 denotes a vertical rod of the vertical springy hinge 70;
numeral 58 denotes a horizontal hinge;
numeral 60 denotes a telescopic rod, as an example of a transverse rod;
numeral 62 denotes a ball bearing of a rail-cart;
numeral 64 denotes a base (chassis) of a rail-cart;
numeral 68 denotes a spiral groove;
numeral 70 denotes a vertical springy hinge;
each of numerals 72, 72*a* and 72*b* denotes a spiral rotation assembly, according to one embodiment of the invention;
number 74 denotes setting means, for setting the operation of the spring 34 to push or pull the vertical rod 56;
numeral 76 denotes fixing means (such as a bolt), for fixing the vertical hinge to the chassis 46;
numeral 78 denotes a tenon correspondingly with groove 68;
numeral 80 denotes a motor;
each of numerals 82*a* and 82*b* denotes a telescopic arm;
numeral 84 denotes a tube of a telescopic assembly, in which is disposed a motor; and
each of numerals 86*a* and 86*b* denotes a pivotal connector.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

The invention claimed is:

1. A stepless sliding door system, comprising:

two sliding doors (10*a*, 10*b*) disposed in a closed state thereof on the same plane, along upper and lower parallel rails (16), at least one of said doors having:
a chassis (46) connected to said sliding door;
two vertical rotatable poles (30);
two pairs of rail-carts (18);
two pairs of hand-connectors (36*a*, 36*b*), each of the hand-connectors firmly connected in one end thereof to one of said vertical rotatable poles (30), and pivotally connected in another end thereof to one of said rail-carts (18);
two spiral rotation assemblies (72*a*, 72*b*), each comprising a vertically shiftable tube (50) in which one of said vertical rotatable poles (30) is disposed, for rotating each of said vertical poles (30) by 90 degrees upon shifting said vertically shiftable tubes (50); and
a transverse rod (60, 54), connecting the vertically shiftable tubes (50) of each of said spiral rotation assemblies (72*a*, 72*b*), for allowing simultaneous shifting of the vertically shiftable tubes (50);

thereby upon vertically shifting one of said vertically shiftable tubes (50), simultaneously rotating said vertical poles (30), resulting in distancing said chassis from said pair of rails (16), thereby placing said sliding door in parallel to the other sliding door, distantly from the other sliding door, thereby allowing sliding said door in parallel to the other door of said sliding door system such that the doors do not block each other.

2. The system according of claim 1, wherein said transverse rod comprises:

a telescopic rod (60) having a tube (22) and two shafts (24*a*, 24*b*), each pivotally connected to one of said vertical poles (30); and a hinge (20) for pivotally connecting said tube (22) to said chassis.

3. The system according of claim 2, further comprising an electric motor (52), for shifting one of said vertically shiftable tubes (50), thereby automating sliding said doors.

4. The system according of claim 1, wherein said transverse rod comprises:

a horizontal bar (54), firmly connected to said vertically shiftable tubes (50), thereby upon vertically shifting one of said vertically shiftable tubes (50), simultaneously shifting the other tube.

5. The system according to claim 4, further comprising an electric motor, for vertically shifting said horizontal bar (54) or said vertically shiftable tube (50).

6. The system according of claim 1, wherein said chassis (46) hangs on the upper of said pair of rails.

7. The system according of claim 1, wherein said chassis stands on the lower of said pair of rails.

8. The system according of claim 1, wherein each of said rail-carts is gyroscopic.

9. The system according of claim 1, wherein each of said rail-carts (18) comprises:

a base (64);

a ball bearing (62), for connecting said base (64) to a corresponding hand-connector (36);

two rollers (42) connected to said base (64) from each side of said ball bearing (62); and a spring (34), for applying pulling or pushing force on said base (64).

* * * * *